US005904468A

United States Patent [19]

Dobler et al.

[11] Patent Number: 5,904,468

[45] Date of Patent: May 18, 1999

[54] FLOW PUMP, ESPECIALLY FOR SUPPLYING FUEL FROM A FUEL TANK OF A MOTOR VEHICLE

[75] Inventors: Klaus Dobler; Michael Huebel, both of Gerlingen; Willi Strohl, Beilstein; Jochen Rose, Hemmingen, all of Germany

[73] Assignee: Robert Bosch GmbH, Stuttgart, Germany

[21] Appl. No.: 08/893,844

[22] Filed: Jul. 11, 1997

[30] Foreign Application Priority Data

Aug. 28, 1996 [DE] Germany ..... 196 34 734

[51] Int. Cl.[6] ..... F04D 5/00

[52] U.S. Cl. ..... 415/55.2; 415/55.1

[58] Field of Search ..... 415/55.1, 55.2, 415/55.3, 55.4, 55.5, 55.6, 55.7

[56] References Cited

U.S. PATENT DOCUMENTS

| | | | |
|---|---|---|---|
| 3,762,832 | 10/1973 | Franck et al. | 415/55.7 |
| 4,923,365 | 5/1990 | Rollwage | 415/55.1 |
| 5,456,575 | 10/1995 | Helmer et al. | 415/55.1 |
| 5,468,119 | 11/1995 | Huebel et al. | 415/55.1 |
| 5,486,087 | 1/1996 | Treiber et al. | 415/55.1 |
| 5,765,992 | 6/1998 | Muramatsu et al. | 415/55.1 |

FOREIGN PATENT DOCUMENTS 4020521 1/1992 Germany .

*Primary Examiner*—Christopher Verdier
*Assistant Examiner*—Richard Woo
*Attorney, Agent, or Firm*—Michael J. Striker

[57] ABSTRACT

The flow pump for supplying a fuel in a motor vehicle includes a pump housing (10) provided with a pump chamber (11) bounded by two radially-extending side walls (12,13) axially spaced from each other and connected with each other by a peripheral wall (14) and a rotatable impeller (24) arranged in the pump chamber (11) coaxial to a pump axis (22). The impeller (24) includes circumferentially spaced radial impeller blades (29) bounding axially open impeller chambers (31) and an outer ring (30) connecting the impeller blades (29) with each other. The two radially-extending side walls (12,13) are provided with respective groove-like side channels (20,21) concentric to the pump axis (22) and open to the pump chamber (11). Each radially-extending side wall (12,13) has an intervening portion (23) between a channel end (212) and a channel beginning (211). The outer ring (30) and the peripheral wall (14) bound a radial space (32,32') between them and the outer ring (30) includes a circumferential radial gap (34) or a plurality of throughgoing passages (37) for providing a fluid flow between a number, advantageously all, of the impeller chambers (31) and the radial space (32,32').

23 Claims, 5 Drawing Sheets

FLOW PUMP, ESPECIALLY FOR SUPPLYING FUEL FROM A FUEL TANK OF A MOTOR VEHICLE

BACKGROUND OF THE INVENTION

The present invention relates to a flow pump, particularly to a flow pump for feeding fuel from a fuel tank of a motor vehicle and, more particularly, to a flow pump of a type that includes a pump housing provided with a pump chamber having two radially-extending side walls axially spaced from each other and connected with each other by a peripheral wall, the two radially-extending side walls being provided with respective groove-like side channels open to the pump chamber and concentric with the pump axis, and a rotatable impeller arranged in the pump chamber and comprising circumferentially spaced radial impeller blades bounding axially open impeller chambers and an outer ring connecting the impeller blades with each other, a radial space being provided between the outer ring and the peripheral wall.

A double-flow flow pump of this kind, which is called a peripheral pump, is described in German Patent Application DE 40 20 521 A1. This double-flow flow pump has a pump chamber bounded by several walls including a side wall and a peripheral wall which are part of an intermediate housing having a pump outlet in it and another side wall which is part of a housing cover having a pump inlet connected with an inlet connector. The impeller arranged in the pump chamber is mounted on a bearing pin on the housing cover and is nonrotatably connected with the drive shaft of an electric motor, which is located in an assembled configuration in the intermediate housing. During operation the flow pump draws fuel in via an inlet connector and forces it through the pump outlet into the pump housing surrounding the interior space of an electric motor and the intermediate housing. The fuel is supplied under pressure through a high pressure pipe to a high pressure connection of the pump housing to the internal combustion engine.

A relatively large radial space exists in this flow pump between the impeller outer periphery and the peripheral wall of the pump chamber so that a convective input of dirt particles into this radial space occurs because of the pressure conditions during feeding of dirt-laden fuel. As a result, comparatively rapid wear and reduced lifetime of the pump occurs.

SUMMARY OF THE INVENTION

It is an object of the present invention to provide an improved flow pump for feeding fuel from a fuel tank of a motor vehicle of the above-described kind, which does not have the above-described disadvantages.

According to the invention, the flow pump for supplying fluid, especially fuel from a fuel tank of a motor vehicle, includes a pump housing having a pump axis and provided with a pump chamber including two radially-extending side walls axially spaced from each other and connected with each other along their peripheries by means of a peripheral wall, wherein at least one of the radially-extending side walls is provided with a groove-like side channel open to the pump chamber, advantageously along a comparatively substantial length of the channel, and concentric with the pump axis, and a rotatable impeller arranged in the pump chamber coaxial to the pump axis and comprising a plurality of radial impeller blades bounding axially open impeller chambers provided in the impeller and circumferentially spaced from each other in a circumferential direction around the impeller and an outer ring connecting the impeller blades with each other. The groove-like side channel has a channel end and a channel beginning and the side wall in which it is located has an intervening portion between the channel end and the channel beginning.

The essential features of the invention include particularly a radial space provided between the outer ring and peripheral wall and a radial flow means in the outer ring for connecting a plurality, advantageously all, of the impeller chambers with the radial space to allow a fluid flow between the radial space and the impeller chambers connected to it.

The flow pump according to the invention has the advantage that it is largely insensitive to dirt-laden pumped fluids, such as dirty fuel. By providing radial flow channels, i.e. the radial flow means, in the outer ring of the impeller the high pressure level in the impeller chambers is at least partially impressed into the radial space so that a pressure profile which is approximately equal to that of the side channels is provided there along the periphery of the outer ring of the impeller. Also a partial flow from the impeller chambers through the radial space to at least one of the side channels is provided by the radial flow means. This partial flow opposes the pumping-in of dirt particles because of its flow direction and thus provides a rinsing action. To avoid a forced circumferential flow in the radial spaced because of the pressure gradients present, the radial gap is kept as small as possible. Good results are obtained with a radial space dimension between 50 to 300 $\mu$m.

According to an advantageous embodiment of the invention the radial flow means is arranged on a symmetry plane of the impeller, advantageously which passes transversely and centrally through the impeller, or in a radial plane extending parallel to the symmetry plane. The pressure gradient and the pressure profile in the side channel are effected by more or less axial displacement of this radial plane. Different rinsing flows in the direction of each side channel can be produced by different axial displacements from the symmetry plane in the direction of these side channels, particularly in a double-flow flow pump in which a side channel is present in each side wall.

In this type of double-flow flow pump it is also advantageous, according to another embodiment of the invention, to distribute radial flow channels through the outer ring between two radial planes parallel to and displaced from the symmetry plane. According to the desired pressure gradient in one or the other side channels the radial planes have the same or different axial spacing from the symmetry plane.

The radial flow means can either be a circumferential gap in the outer ring of the impeller extending around the entire impeller circumference in one embodiment or a plurality of throughgoing passages in the outer ring in another embodiment. In both embodiments the circumferential gap opens onto the inner surface of the impeller outer ring or the throughgoing passages open onto an inner surface of the impeller outer ring in respective impeller chambers. The latter embodiment is particularly advantageous because the rinsing volume flow can be exactly tuned for optimum rinsing action by a suitable positioning of the throughgoing passages between the front and rear side of the blades.

According to a preferred embodiment of the invention the circumferential gap or throughgoing passages are formed so that the area or flow cross-section of the gap and/or passages increases from inner surface to the outside surface of the outer ring, also in the direction of increased distance from the impeller axis. Because of that, an advantageous diffuser effect results.

In a preferred embodiment of the invention the radial space between the outer ring and the peripheral wall has a radial height which decreases continuously with increasing circumferential angle over the impeller circumference and the radial height has its greatest value in the vicinity of the beginning of the side channel in the at least one side wall. This embodiment has the advantage that it is largely insensitive to dirt-laden fuel pumped through it. A pressure profile, which is similar to the pressure profile in at least one side channel, is built up in the radial space according to the shape of the radial space, particularly its radial height, which leads to a pressure equalization or compensation between the radial space and the side channels along the entire circumference of the impeller. Because of that, a fluid flow from the side channels to the radial space and thus introduction of dirt particles into the radial space is prevented. The flow pump, because of that, does not show much wear and has a comparatively long life expectancy. The dimensioning of the radial space between the peripheral wall and the outer ring according to the invention is especially suitable for a flow pump, which supplies high viscosity liquid, e.g. diesel fuel, since comparatively greater radial space dimensions are required for this type of liquid.

A satisfactory pressure profile is obtained for gasoline fuel even with a linear dependency of the radial space height over the circumference of the impeller and with that a clear reduction of the convection-induced particle feed into the radial space.

By computing the radial space height h according to the hydrodynamic lubricant gap theory for each circumferential angle β a pressure dependence which is almost ideal in the side channels is obtained in flow pumps for gasoline fuel. The dependence of radial height h as a function of circumferential angle β can be obtained from the algebraic formula I according to a preferred embodiment $$h(\beta)=h_o[1-0.667(\beta/360°)^{6.5}+0.212(\beta/360°)^{16}] \quad \text{(I).}$$

The starting radial space height is between 25 to 75 μm, advantageously about 35 μm. The final point of the circumferential angle β (also β=0°) is thus set so that it lies on the an axis parallel to the pump axis and passing through the center of the pump entrance opening.

In several advantageous embodiments the radial space between the outer ring and the peripheral wall has a radial height, which decreases continuously with increasing circumferential angle over the impeller circumference of the impeller and the radial height has its greatest value in the vicinity of the beginning of the side channel in the at least one side wall. For example, the radial height can decrease continuously and linearly with circumferential angle around a circumference of the impeller and, advantageously, is formed by a planar side portion of a side wall. It is particularly desirable when means for supplying gasoline fuel at a nominal feed pressure of 3 bar are provided in the pump, and the radial height is between about 20 to 100 μm, advantageously about 45 μm, at a circumferential angle of about 5° and between about 10 to 80 μm, advantageously about 25 μm, at a circumferential angle (β) of about 360°. Alternatively the flow pump can include means for supplying diesel fuel at a nominal feed pressure of 3 bar, and the radial height of the radial space is about 160 μm at a circumferential angle of about 5° and about 75 μm at a circumferential angle of about 360°.

In a preferred embodiment one side wall is provided with a connecting groove open to the pump chamber and connecting the radial space between the peripheral wall and the outer ring with the side channel. This groove can serve for determination of the absolute pressure in the radial space. This type of connecting groove can of course be provided in both side walls in embodiments in which a side channel is provided in each side wall.

In particularly preferred embodiments of the invention the flow pump is also provided with an intermediate housing including the peripheral wall and one side wall and containing a pump passage and with a housing cover including another side wall and a pump inlet. The housing cover is attached rigidly to the intermediate housing and/or the pump housing.

The variable height radial space between the peripheral wall the outer impeller ring is formed advantageously by working or machining the peripheral wall. The radial space is formed satisfactorily during manufacture in this way.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
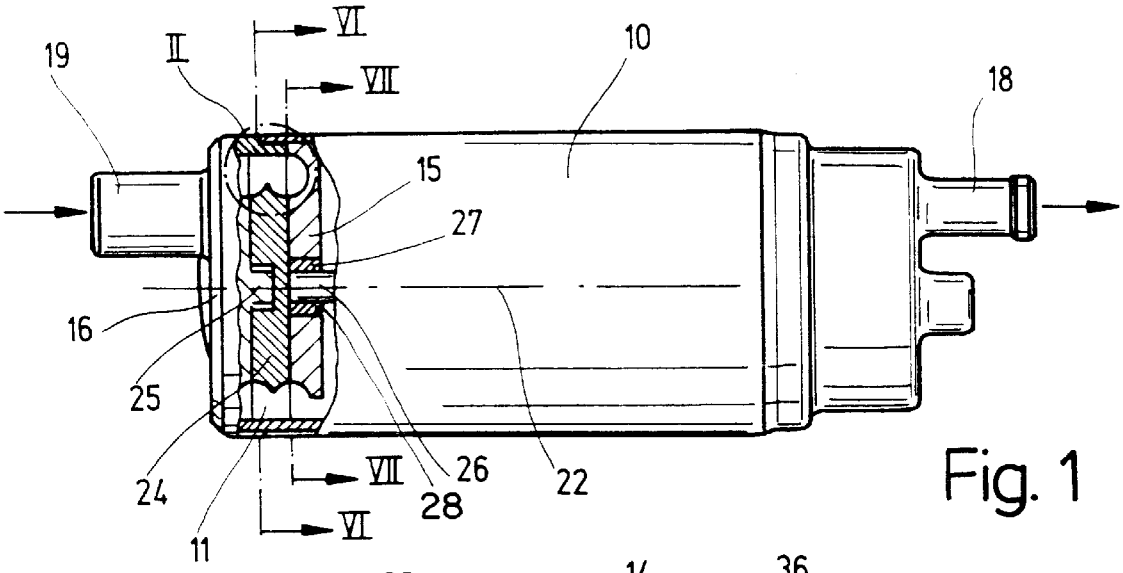
FIG. 1 is a partially side elevational, partially cross-sectional view of the flow pump for supplying fuel according to the invention.

The flow pump seen in side view in FIG. 1, also known as a side channel pump, supplies fuel from an unshown fuel tank of a motor vehicle to a likewise unshown internal combustion engine of the motor vehicle. The flow pump has a pump chamber 11 formed in a pump housing 10, which is bounded (FIG. 2) by two radially extending, side walls 12,13 spaced from each other and a peripheral wall 14 connected with the side walls 12,13 along their periphery. The side wall 13 and the peripheral wall 14 are part of an intermediate housing 15, while the side wall 12 is part of a housing cover 16, which is rigidly connected with the intermediate housing 15 and/or the pump housing 10. The pump housing 10 encloses the intermediate housing 15 and has an unshown electric motor in its interior. A pump passage 17, which connects the interior of the pump housing 10 with the pump chamber 11 and which extends axially through the side wall 13, is provided in the intermediate housing 15. The pump housing 10 is provided with a high-pressure connection 18, to which the fuel supplied by the flow pump via the pump passage 17 flows. The housing cover 16 has a low-pressure connection 19 for drawing in fuel from the fuel tank, which is connected with a pump inlet passage extending through the side wall 12 but not seen in the drawing figures.

Figure 2:
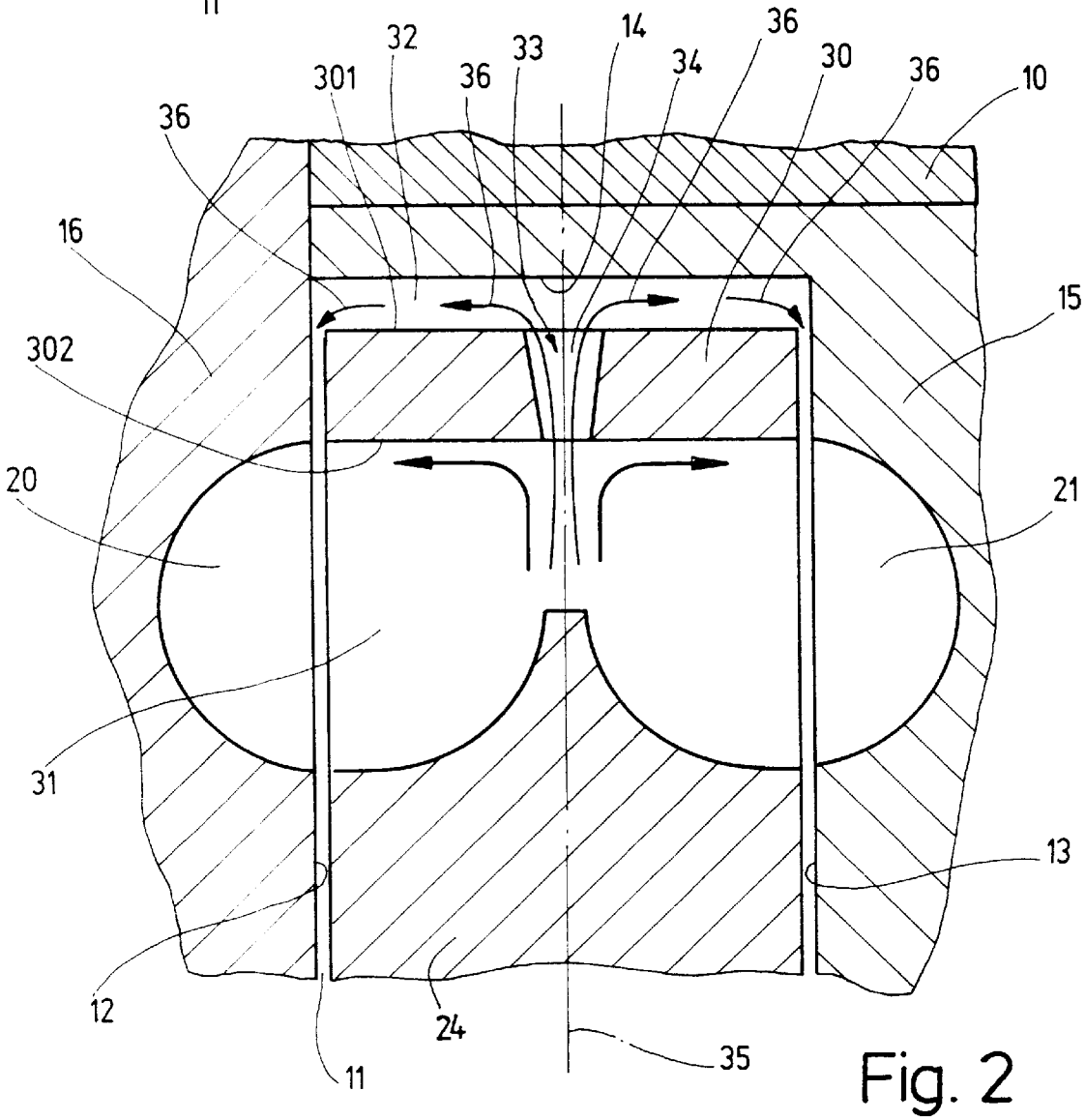
FIG. 2 is a detailed cutaway longitudinal cross-sectional view through the flow pump shown in FIG. 1 in the cutaway portion indicated with II—II.
Figure 7:
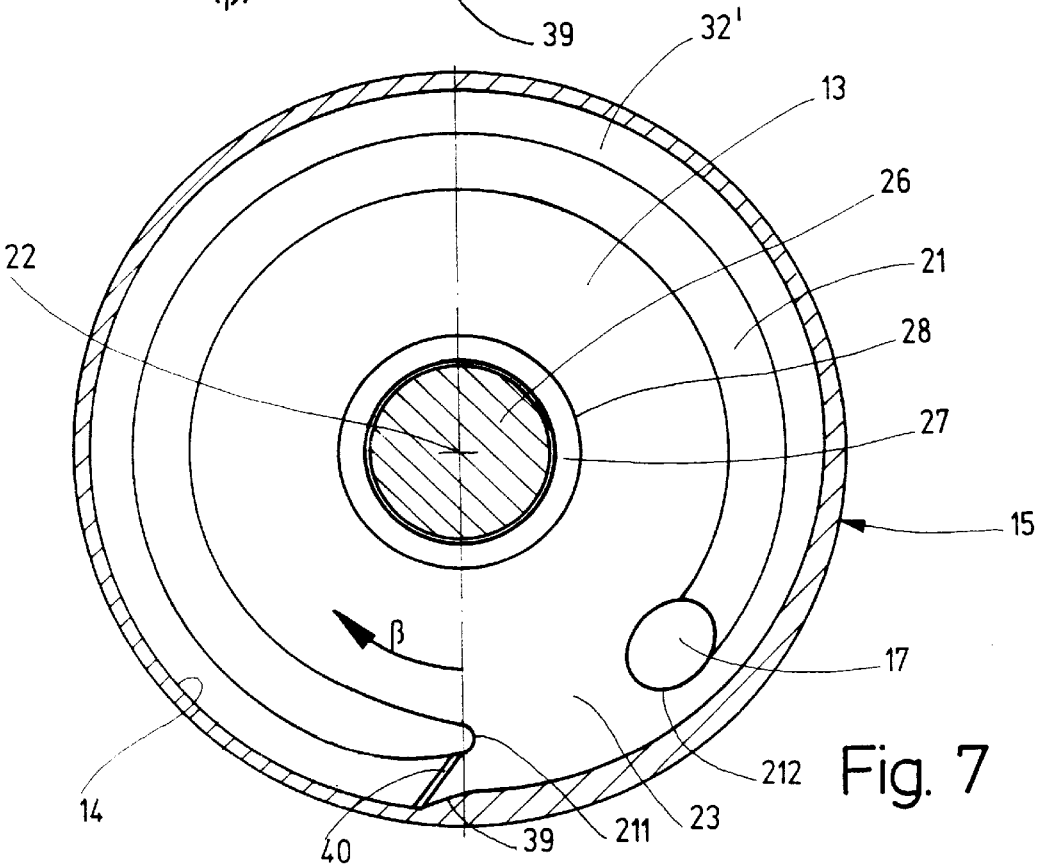
FIG. 7 is a cross-sectional view of a modified flow pump taken along the section line VII—VII of FIG. 1.

In the double-flow flow pump formed here a side channel 20 and/or 21 is formed in each side wall 12,13. As seen in FIG. 2, each groove-like side channel 20,21 has a semicircular cross-section and is open so as to face the pump chamber 11. As is shown in FIG. 7 for the side channel 21 formed in the side wall 13 in the intermediate housing 15, each side channel extends concentric to the pump axis 22 and almost around the entire circumference of the side wall 13 and/or 12 with an intervening portion 23 of the side wall 13 between its beginning and end. An intervening portion 23 extends between the beginning 211 of the side channel 21 and the end 212 of the side channel 21. The beginning 211 of the side channel 20 in the side wall 12 on the housing cover 16 is connected with the pump inlet passage (and this again is connected with the low-pressure connection 19) and the end 212 of the side channel 21 formed in the side wall 13 on the intermediate housing 15 is connected with the pump passage (and this again is connected with the high pressure connector 18 via the interior of the pump housing 10).

A pump impeller 24 is arranged in the pump chamber 11 coaxial to the pump axis 22. The impeller 24, on one side, is mounted on bearing pin 25 which projects into the pump chamber 11 coaxial to the side wall 12, and, on the other side, is nonrotatably connected to a drive shaft 26 of the unshown electric motor, which is supported in a bearing bushing 27 coaxial to the pump axis 22. The bearing bushing 27 is pressed in a coaxial passage 28 and extends through the side wall 13 in the intermediate housing 15. The impeller 24 has a plurality of impeller blades 29 which are spaced from each other in a circumferential direction and are connected with each other by a circular outer ring 30 at their ends remote from the pump axis 22. Axially open impeller chambers 31 are formed in the impeller 24 and are bounded by the impeller blades 29. The impeller blades 29 and the outer ring 30 are formed in one piece with the impeller 24. The impeller blades 29 are formed as cross pieces between openings in the impeller 29 arranged on a common dividing circle on the impeller 24. The outer ring 30 is dimensioned so that between the circumferential outer surface 301 of the outer ring 30 and the peripheral wall 14 a radial space 32 is present (FIG. 2). In operation the flow pump draws fuel through the low-pressure connection 19 and forces the fuel through the pump passage into the interior of the pump housing 10. From there the fuel is pumped into the internal combustion engine via the high-pressure connection 18. A pressure profile is formed in both side channels 20,21 so that the pressure grows from the beginning of a side channel to its end and reaches a maximum a certain distance from its end.

Radial flow means 33 is provided through the outer ring 30 in the embodiments of the flow pump shown in FIGS. 2 to 5, which connects the individual impeller chambers 31 with the radial space 32. Because of that, the high pressure level in the impeller chambers 31 is impressed into the radial space 32 so that a pressure profile corresponding to the pressure profile in the side channels 20,21 also exists there along the circumference of the outer ring 30. The pressure gradient present between the impeller chambers 31 and the radial space 32 also causes a partial flow from the impeller chambers 31 through the radial space 32 to the side channels 20,21, which opposes the introduction of dirt particles in the fuel by its flow direction and thus produces a rinsing action. Possibilities for fine tuning the volume flow are offered by the design of the cross-sectional form and positioning of the flow passages 33, which connect the individual impeller chambers 31 with the radial space 32. The radial space 32 can be dimensioned as narrowly as possible in order to avoid an impressed circumferential flow (Poiseuilee Flow) in the radial space 32 because of the pressure gradient present. The radial height of the radial space is advantageously in a range from 50 to 300 $\mu$m.

The radial flow means 33 is formed by a circumferential gap 34 which extends from the inner surface 302 to the outer surface 301 of the outer ring 30 and circumferentially around the outer ring 30 in the embodiment of the flow pump shown in FIG. 2. The circumferential gap 34 has a trapezoidal cross-section with its larger base line at the outer surface 301 of the outer ring 30 so that the flow cross-section for the volume flow into the outer ring 30 increases with increasing radial spacing from the pump axis 22. The circumferential gap 34 is arranged centrally with respect to a symmetry plane 35 of the outer ring 30. This symmetry plane 35 passes transversely and centrally through the outer ring 30. The volume flow through the radial space 32 to the side channels 20, 21 are symbolized by the arrows 36 in FIGS. 2 and 3.

Figure 4:
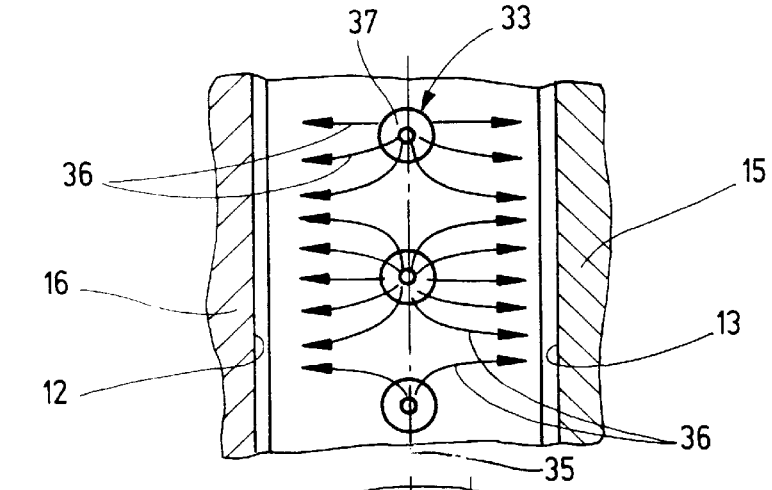
FIG. 4 is a top plan view of the impeller in another embodiment of the flow pump according to the invention.
Figure 5:
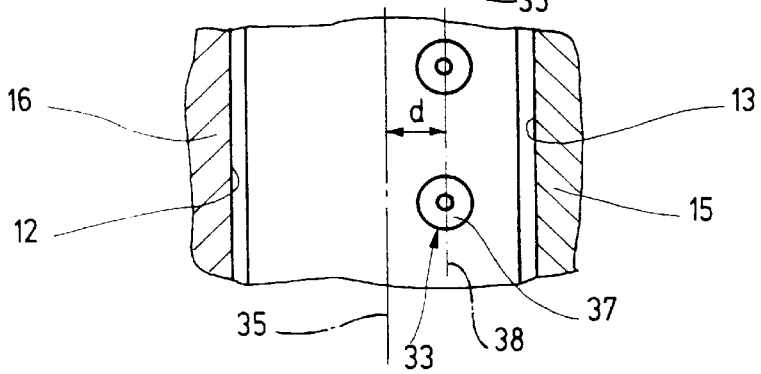
FIG. 5 is a top plan view of the impeller in an additional embodiment of the flow pump according to the invention.

In another embodiment of the flow pump according to FIGS. 4 and 5 the radial flow means 33 comprises a plurality of throughgoing radial passages 37 provided through the outer ring 30. The radial passages 37 extend completely through the outer ring 30 from its outer surface 301 to its interior surface 302 in the impeller chambers 31. The passages 37 are each shaped like a truncated cone which widens from the inner surface 302 to the outer surface 301 of the outer ring 30. In the embodiment according to FIG. 4 the passages 37 are arranged in the symmetry plane 35 of the outer ring 30. In this embodiment one obtains two equal size partial flows to each side channel 20,21. In the embodiment of FIG. 5 the passages 37 are arranged in a radial plane 38 which is axially displaced a distance d from and parallel to the symmetry plane 35 of the outer ring 30. Because of this axial displacement, the rinsing flows in the direction of the housing cover 16 and the intermediate housing 15 can be different.

Figure 3:
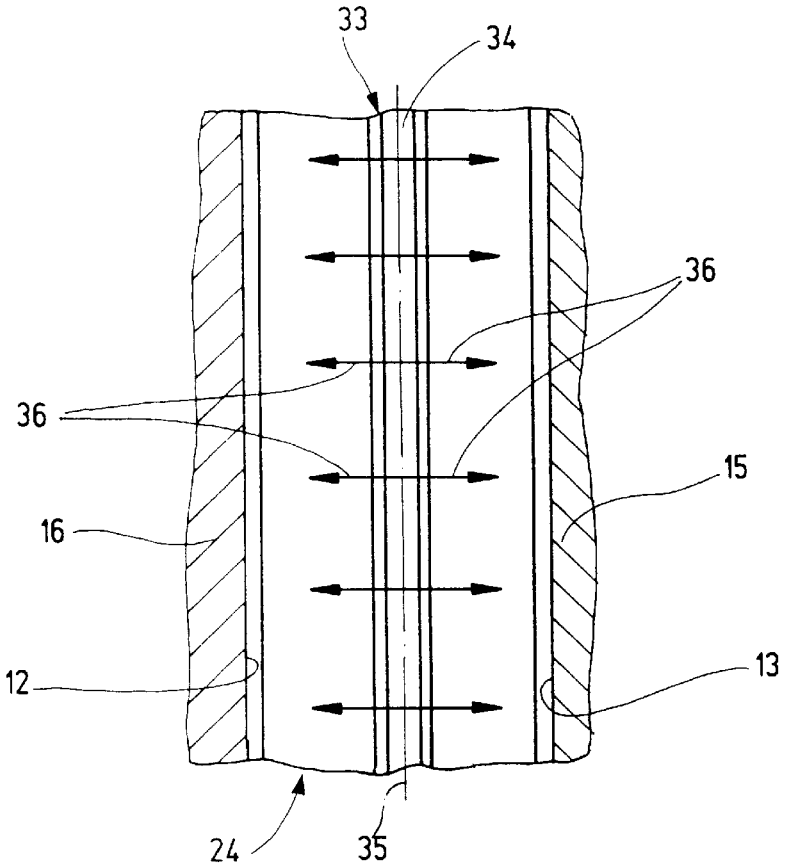
FIG. 3 is a top plan view of the impeller in the flow pump of FIG. 1.

In an embodiment of the flow pump not shown here the circumferential gap 34 in the outer ring 30 of the impeller 24 can be similarly axially displaced in relation to the embodiments of FIGS. 2 and 3 in order to provide different partial rinsing flows to each side channel 20,21. The same effect can be obtained by two circumferential gaps 34 which extend in two radial planes of the outer ring 30 arrange parallel to the symmetry plane 35, so that the spacing of each radial plane from the symmetry plane 35 can be the same or different. Understandably it is also possible to distribute the passages 37 in two radial planes which are displaced about an equal or somewhat different axial distance from the symmetry plane 35. However a passage 37 is always associated with a impeller chamber 31 and opens into it.

The circumferential gap can be formed with gap walls extending parallel to each other. Similarly the passages 37 can be cylindrical. The form of both the circumferential gap 34 and the throughgoing passages 37 is such that its flow cross-section widens in the radial direction since a certain diffuser action is obtained because of that.

Figure 6:
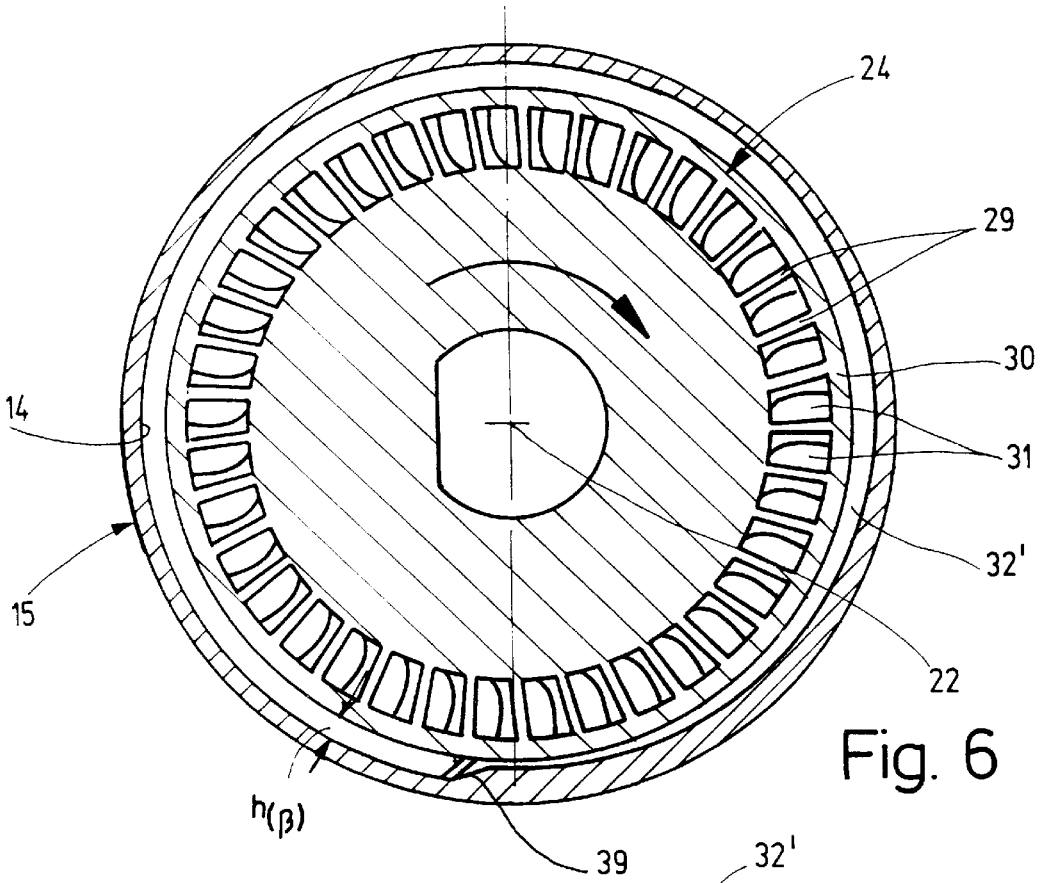
FIG. 6 is a cross-sectional view of a modified flow pump taken along the section line VI—VI of FIG. 1.

In the embodiments of the flow pump shown in FIGS. 6 and 7, the pressure profile in the radial space 32' is adjusted according to the pressure profile in the side channels 20,21 so that the height h of the radial space 32' decreases continuously over the circumference of the outer ring 30 with increasing circumferential angle β and has its largest size in the vicinity of the side channel beginnings 211 for prevention of dirt particle introduction into the radial space. To accomplish this the peripheral wall 14 on the intermediate housing 15 is appropriately worked or machined with the circular outer circumference 301 of the outer ring 30 on the impeller 24. The transition from starting size to the final size of the radial space 32' is linear and is provided by a planar side portion 39 of the peripheral wall 14.

The behavior or variation of the radial space height h(β) with the circumferential angle β is selected to be linear for a simple manufacture. This type of variation of the gap height h over the concerned gap length (β/360°) is shown by the characteristic curve b in FIG. 8. To supply diesel fuel, which has a higher viscosity than gasoline, at a nominal feed pressure of 3 bar and with this type of radial space variation the beginning size of the radial space height at β=5° or about 5° is about 160 μm and the end size of the radial space height at β=360° or about 360° is about 75 μm. With this type of radial space variation and at the nominal feed pressure of 3 bar for the diesel fuel, the pressure variation or behavior in the radial space 32' is as indicated in the diagram in FIG. 9 with b. This pressure variation corresponds to a good approximation to the desired pressure variation as it is in the side channels 20,21 of the flow pump and is as shown by the characteristic curve a in the graphical illustration in FIG. 9.

Figure 8:
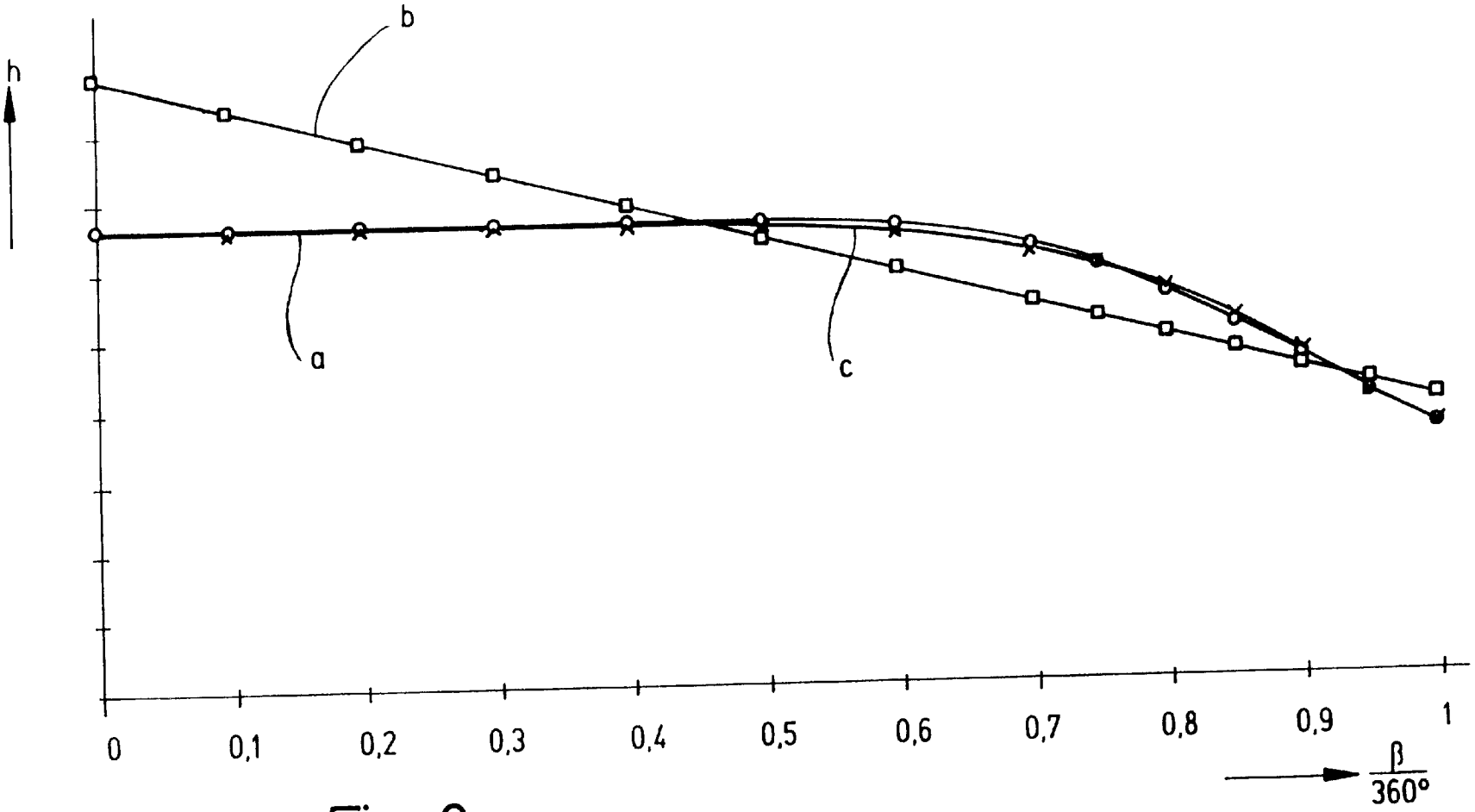
FIG. 8 is a graphical illustration of three different radial space height variation functions in the flow pump according to FIGS. 6 and 7.
Figure 9:
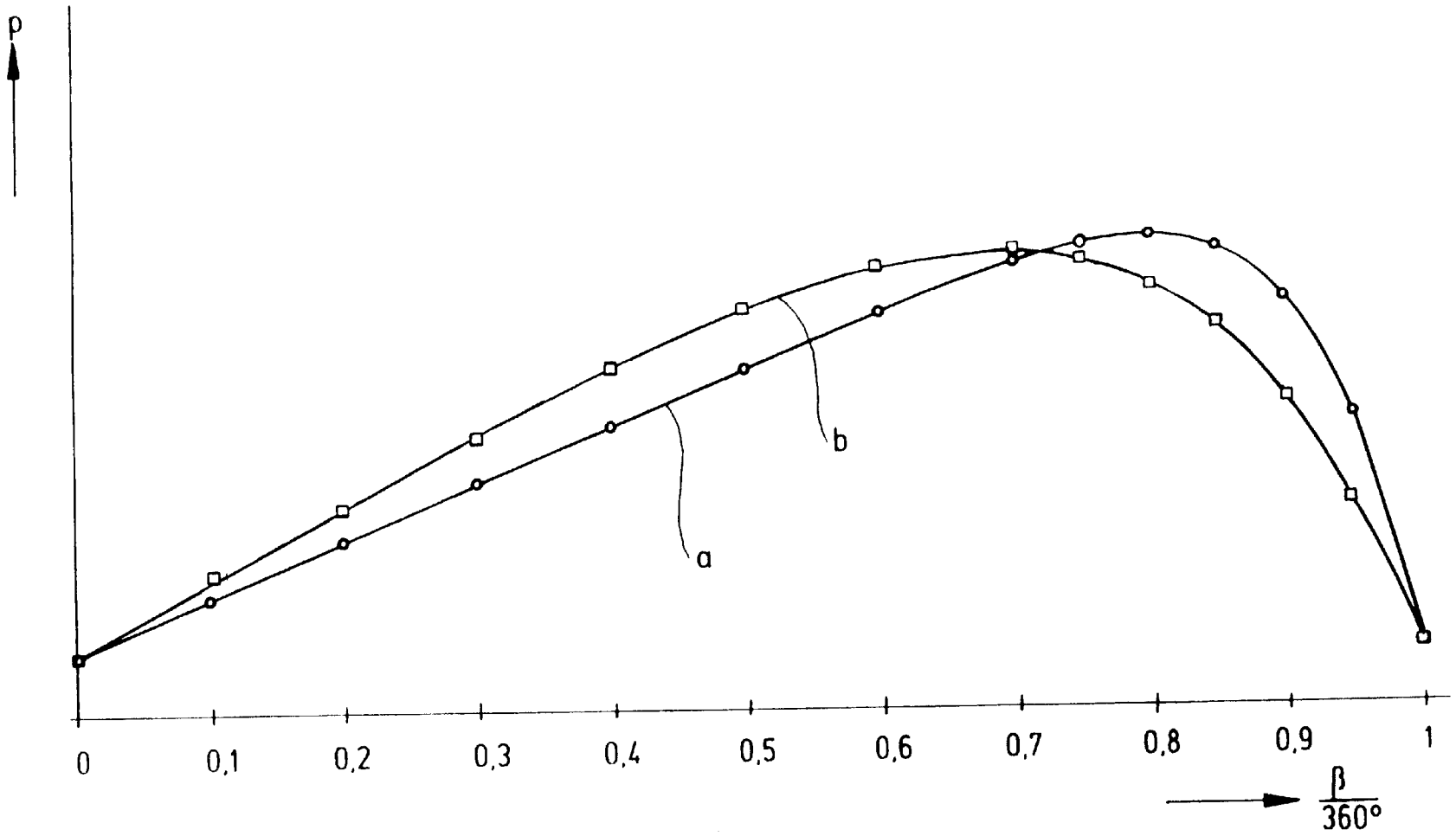
FIG. 9 is a graphical illustration of the behavior of pressure in the radial space of the flow pump according to FIGS. 5 and 7.

The characteristic curve a in FIG. 9 indicates the desired pressure variation or function in the radial space 32' which optimally corresponds to the pressure variation in the side channels 20,21 during supply of the gasoline. If the radial space variation of a flow pump is linear as shown with characteristic line b in FIG. 8, the gasoline is supplied at a nominal feed pressure of 3 bar, so the beginning size of the radial space height h (at β=5° or about 5°) is between 20 and 100 μm, or between about 20 and 100 μm, and the end size of the radial space height (at β=360° or about 360°) is between 10 to 80 μm, or between about 10 to about 80 μm. Advantageously the beginning size is 45 μm and the end size is 25 μm. With this type of radial space behavior or variation a pressure variation in radial space 32' exists as shown by the characteristic curve b in FIG. 9, which has a nominal variation from the ideal gap pressure behavior according to characteristic curve a. However even so introduction of dust or dirt particles in the fuel into the radial space 32' is largely prevented.

When gasoline is being supplied by the pump, the ideal pressure behavior in the radial space 32' according to the characteristic curve a in FIG. 9 is obtained with a radial space function as shown in FIG. 8 by the characteristic curve a. The gap height h over the concerned gap length (β/360°) is computed according to the hydrodynamic lubricant gap theory for each circumferential angle β. The radial space can be approximated by the following algebraic formula I:

$$h(\beta)=h_o[1-0.667(\beta/360°)^{6.5}+0.212(\beta/360°)^{16}] \quad \text{(I)},$$

wherein $h_o$ is in a range of from 25 to 75 μm. The starting angle β=0, is such that it lies on an axis passing through the center of the pump passage opening to the pump axis 22, as it is shown in FIG. 7. This approximate behavior of the radial space height h(β) is shown by the characteristic curve c in FIG. 8. The pressure variation in the radial space 32' according to characteristic curve a in FIG. 9 results from this radial space function with a feed or supply pressure of 3 bar.

A connecting groove 40 open to the pump chamber 11 is provided which connects the radial space 32' with the side channel 21 for establishing the absolute pressure. Another connecting groove can be provided also in the housing cover 16 in the side wall 12 and there connects the beginning of the side channel 20 with the radial space 32'.

The invention is to be considered limited to the particular embodiments described hereinabove. Thus, e.g., the flow pump can also be a single-flow flow pump, so that only one side channel is provided in a side wall, whose side channel beginning is connected with the pump entrance and whose side channel end is connected with the pump outlet. The side channel can be formed in an intermediate housing or in the housing cover.

The disclosure in German Patent Application 196 34 734.3 of Aug. 28, 1996 is incorporated here by reference. This German Patent Application, at least in part, describes the invention described hereinabove and claimed in the claims appended herein in below and provides the basis for a claim of priority for the instant invention under 35 U.S.C. 119.

While the invention has been illustrated and described as embodied in a flow pump of the above-described type, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A flow pump for supplying a fluid comprising a pump housing (10) having a pump axis (22) and provided with a pump chamber (11);

two radially-extending side walls (12,13) axially spaced from each other and peripherally connected with each other by means of a peripheral wall (14), wherein at least one of said two radially-extending side walls (12,13) is provided with a groove-like side channel (20,21) open to said pump chamber (11) and concentric with the pump axis (22), said groove-like side channel (20,21) has a channel end (212) and a channel beginning (211) and said at least one radially-extending side wall has an intervening portion (23) between the channel end (212) and the channel beginning (211); and a rotatable impeller (24) arranged in the pump chamber (11) coaxial to the pump axis (22), said rotatable impeller (24) comprising a plurality of radial impeller blades (29) bounding axially open impeller chambers (31) provided in the impeller and spaced from each other in a circumferential direction around the impeller and an outer ring (30) connecting the impeller blades (29) with each other, wherein said outer ring (30) and said peripheral wall (14) bound a radial space (32,32') between said outer ring (30) and said peripheral wall (14) and said outer ring (30) includes radial flow means (33) for connecting a number of said impeller chambers (31) with said radial space (32,32') to allow a fluid flow between each of said number of said impeller chambers (31) and said radial space (32,32').

2. The flow pump as defined in claim 1, wherein said radial flow means (33) is arranged in a symmetry plane (35)

of the outer ring (30), said symmetry plane (35) passing centrally and transversely through said outer ring (30).

3. The flow pump as defined in claim 1, wherein said radial flow means (33) is arranged in a radial plane (38) displaced from and parallel to a symmetry plane (35) of the outer ring (30) passing centrally and transversely through said outer ring (30).

4. The flow pump as defined in claim 2, wherein one (12) of said two side walls (12,13) is provided with one (20) of said groove-like side channels (20,21) and said channel beginning thereof is connected with a pump inlet and another (13) of said two side walls (12,13) is provided with another (21) of said groove-like side channels (20,21) and said channel end (212) is connected with a pump passage (17).

5. The flow pump as defined in claim 1, wherein one (12) of said two side walls (12,13) is provided with one (20) of said groove-like side channels (20,21) and said channel beginning thereof is connected with a pump inlet and another (13) of said two side walls (12,13) is provided with another (21) of said groove-like side channels (20,21) and said channel end (212) is connected with a pump passage (17), and wherein said radial flow means (33) is arranged in two radial planes displaced from and parallel to a symmetry plane (35) of the outer ring (30) passing centrally and transversely through said outer ring (30), said two radial planes being spaced respective axial distances from said symmetry plane.

6. The flow pump as defined in claim 1, wherein the outer ring (30) has an outer surface (301) facing the peripheral wall (14) and an inner surface (302) on a side opposite to the outer surface and the radial flow means (33) has a flow cross-section which increases from the inner surface (302) of the outer ring (30) to the outer surface (301).

7. The flow pump as defined in claim 6, wherein said radial flow means (33) consists of a circumferential gap (34) in said outer ring (30) extending circumferentially around said outer ring (30) and said circumferential gap (34) widens from the inner surface (302) to the outer surface (301) of the outer ring (30).

8. The flow pump as defined in claim 7, wherein said circumferential gap (34) has a trapezoidal transverse cross-section having a comparatively larger base side and a comparatively smaller base side and said comparatively larger base side extends in said outer surface (301) of said outer ring (30).

9. The flow pump as defined in claim 6, wherein said radial flow means (33) consists of a plurality of radially extending throughgoing passages (37) in the outer ring (30) and said radial passages (37) open into each of said impeller chambers (31).

10. The flow pump as defined in claim 9, wherein each of said radially extending throughgoing passages (37) is conical and has a passage cross-section and the passage cross-section widens from the inner surface (301) to the outer surface (302) of said outer ring (30).

11. The flow pump as defined in claim 1, wherein the radial space (32') between the outer ring (30) and the peripheral wall (14) has a radial height (h), said radial height (h) decreases continuously with increasing circumferential angle (β) over a circumference of the impeller (24) and said radial space (32') between the peripheral wall (14) and the outer ring (30) has a greatest value of the radial height (h) in the vicinity of the channel beginning (211) of said side channel in the at least one side wall (13).

12. The flow pump as defined in claim 11, wherein said radial height (h) decreases continuously and linearly with said increasing circumferential angle (β) around a circumference of the impeller (24) and is formed by a planar side portion (39) of said peripheral wall.

13. The flow pump as defined in claim 11, wherein said radial height (h) decreases continuously and linearly with said increasing circumferential angle (β).

14. The flow pump as defined in claim 13, wherein said radial height (h) is between about 20 to 100 μm at a circumferential angle (β) of about 5° and said radial height (h) is between about 10 to 80 μm at a circumferential angle (β) of about 360° when said fluid supplied by the flow pump is gasoline fuel and said gasoline fuel is supplied at a feed pressure of 3 bar.

15. The flow pump as defined in claim 14, wherein said radial height (h) is about 45 μm at a circumferential angle (β) of about 5° and said radial height (h) is about 25 μm at a circumferential angle (β) of about 360°.

16. The flow pump as defined in claim 13, wherein said radial height (h) is about 160 μm at a circumferential angle (β) of about 5° and said radial height (h) is about 75 μm at a circumferential angle (β) of about 360° when said fluid supplied by the flow pump is diesel fuel and said diesel fuel is supplied at a feed pressure of 3 bar.

17. The flow pump as defined in claim 11, wherein said radial height (h) is given by the formula I:

$$h(\beta)=h_o[1-0.667(\beta/360°)^{6.5}+0.212(\beta/360°)^{16}] \quad \text{(I)},$$

wherein $h_o$ is said radial height when β=0.

18. The flow pump as defined in claim 13, wherein said radial height ($h_o$) is between about 25 and 75 μm at β=0 when said fluid supplied by the flow pump is gasoline fuel and said gasoline fuel is supplied at a feed pressure of 3 bar.

19. The flow pump as defined in claim 18, wherein said radial height ($h_o$) is about 36 μm at β=0.

20. The flow pump as defined in claim 11, wherein the variation in the radial height (h) between the peripheral wall (14) and the outer ring (30) with the increasing circumferential angle (β) is obtained by machining the peripheral wall (14).

21. The flow pump as defined in claim 11, wherein the at least one of said two side walls provided with said groove-like side channel is provided with a connecting groove (40) open to said pump chamber (11) and said connecting groove (40) connects the radial space (32') between the peripheral wall (14) and the outer ring (30) with said side channel at the channel beginning thereof.

22. The flow pump is defined as in claim 11, wherein one (12) of said two side walls (12,13) is provided with one (20) of said groove-like side channels (20,21) and said channel beginning thereof is connected with a pump inlet and another (13) of said two side walls (12,13) is provided with another (21) of said groove-like side channels (20,21) and each of said two side walls (12,13) is provided with a connecting groove (40) for connecting said side channels with said radial space.

23. The flow pump as defined in claim 1, further comprising an intermediate housing (15), said intermediate housing including the peripheral wall (14), one (13) of the two side walls (12,13) and containing a pump passage (17), and a housing cover (16) including another (12) of the two side walls (12,13) and a pump inlet, and wherein said housing cover (16) is attached rigidly to at least one of said intermediate housing (15) and said pump housing (10).

* * * * *